US006109159A

United States Patent [19]

Seto

[11] Patent Number: 6,109,159

[45] **Date of Patent: *Aug. 29, 2000**

[54] TURRET PUNCH PRESS

[75] Inventor: Yoshiharu Seto, La Mirada, Calif.

[73] Assignee: Amada MFG America, Inc., La Mirada, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/070,776

[22] Filed: May 1, 1998

[51] Int. Cl.[7] ..... B26D 7/26

[52] U.S. Cl. ..... 83/699.31; 83/552; 83/559; 83/698.91

[58] Field of Search ..... 83/552, 559, 620, 83/621, 640, 684, 698.91, 699.31, 641

[56] References Cited

U.S. PATENT DOCUMENTS

| | | | |
|---|---|---|---|
| 3,741,056 | 6/1973 | Saladin | 83/698.91 |
| 3,779,122 | 12/1973 | Sawvell | 83/698.91 |
| 4,014,232 | 3/1977 | Mauger | 83/559 X |
| 4,412,469 | 11/1983 | Hirata et al. | 83/552 |
| 4,486,941 | 12/1984 | Scott et al. | 83/552 X |
| 5,195,413 | 3/1993 | Johnson | 83/552 X |
| 5,215,513 | 6/1993 | Maynard et al. | 483/29 |
| 5,263,237 | 11/1993 | Gallant et al. | 83/552 X |
| 5,342,276 | 8/1994 | Fujiwara et al. | 83/552 X |
| 5,346,454 | 9/1994 | Hayashi | 483/29 |
| 5,499,566 | 3/1996 | Endo et al. | 83/684 X |
| 5,522,295 | 6/1996 | Chun | 83/552 |
| 5,545,116 | 8/1996 | Seto | 83/552 X |
| 5,616,112 | 4/1997 | Seto et al. | 83/552 X |
| 5,901,628 | 5/1999 | Sakamoto et al. | 83/552 |

FOREIGN PATENT DOCUMENTS

| | | | |
|---|---|---|---|
| 4754B/89 | 2/1989 | Italy . | |
| 34534 | 2/1989 | Japan | 83/552 |
| 3-60822 | 3/1991 | Japan . | |
| 405285564 | 11/1993 | Japan | 83/552 |
| 7136724 | 5/1995 | Japan . | |
| 2659679 | 6/1997 | Japan . | |
| 2070492 | 9/1981 | United Kingdom | 83/552 |

*Primary Examiner*—Rinaldi I. Rada
*Assistant Examiner*—Charles Goodman
*Attorney, Agent, or Firm*—Greenblum & Bernstein, P.L.C.

[57] ABSTRACT

In a turret punch press (1) which rotates and indexes an upper turret (5) and a lower turret (7), positions a desired punch and die from a plurality of punches (P) and a plurality of dies (D) to a processing position (25), and performs a punching process in cooperation with the punch and the die, in the case that a core of the die with respect to the punch is offset at a time of replacing the die or after a long time use, since a hole (133) for a bolt (135) fastening a die holder (129) to the lower turret (7) is great, the bolt (135) is loosened so as to adjust a position of the die holder (129) with respect to the lower turret (7).

8 Claims, 7 Drawing Sheets

TURRET PUNCH PRESS

BACKGROUND OF THE INVENTION

1. Field of the Invention

The present invention relates to a turret punch press, and more particularly to a turret punch press having a characteristic structure for mounting a die to a lower turret.

2. Description of the Related Arts

Conventionally, an upper turret mounting a plurality of punches in a freely selecting manner and a lower turret mounting a plurality of dies in a freely selecting manner have the same diameter, and generally, the desired punch and die are synchronously rotated and indexed to a processing position and the punch is hit so as to perform a punching process to the work.

In the turret punch press of this kind, the upper turret and the lower turret are disposed such as to be freely rotated and indexed in a synchronous manner. A plurality of punches are mounted to the upper turret, and a plurality of dies are mounted to the lower turret.

The die is mounted to the lower turret through a die holder in such a manner as to oppose to the punch mounted to the upper turret. The die holder is provided with an upper die holder mounting the die and a lower die holder for mounting the upper die holder to the lower turret. The lower die holder is fixed to the lower turret by means of a mounting bolt. Accordingly, the die is fitted into the upper die holder, and the upper die holder is mounted to the lower die holder by means of a corner bolt. Accordingly, the die will be mounted to the lower turret.

However, in the turret punch press of this kind, since a gap between a lower surface of the upper turret and an upper surface of the upper die holder mounted to the lower turret is small, it is necessary to remove and take out the upper die holder from the lower die holder so as to replace the die at a time of replacing the die.

Further, at a time of setting the die, the die is inserted into the upper die holder and the upper die holder is mounted to the lower die holder. At this time, there has been a problem that a mounting position of the upper die holder is scattered, so that a core of the die is off-set with respect to a core of the punch every time when the die is replaced.

Accordingly, as described in Italian Utility Model No. 4745B/89, Japanese Patent 2659679 (Japanese Patent Unexamined Publication No. 7-136724) or Japanese Patent Unexamined Publication No. 3-60822, a turret punch press which is structured such that an outer diameter of the lower turret is made greater than an outer diameter of the upper turret is suggested. In the turret punch press mentioned above, since a part of the lower turret is exposed outside the upper turret, the die fitted into the lower turret through a faucet type die holder can be easily replaced only by pulling out to an immediately upward direction, thereby solving the problem mentioned above.

However, in the turret punch press which is structured to make the outer diameter of the lower turret mentioned above greater than the outer diameter of the upper turret, there is a problem that an alignment with respect to the punch can not be adjusted at a time of replacing the die. Accordingly, the upper turret and the lower turret have to be strictly processed at a time of manufacturing the turret punch press, so that a productivity is deteriorated.

Further, when the punch and the die are worn away due to a long time use, a clearance between the punch and the die becomes uneven, so that a great burr is locally generated at a punched portion in the work, whereby a problem of becoming impossible to be used is generated.

SUMMARY OF THE INVENTION

The present invention has been achieved with such points in mind.

It therefore is an object of the present invention to provide a turret punch press which can easily replace the die and can easily adjust the alignment of the die.

To achieve the object, according to a first aspect of the present invention, there is provided a turret punch press, comprising: an upper turret holding a plurality of punches and freely rotated and indexed; a lower turret having a diameter greater than that of the upper turret, the lower turret holding a plurality of dies for performing a punching process in cooperation with the punch, the lower turret being freely rotated and indexed, and the lower turret being rotatably supported at a processing position in such a manner that the punch and the die are opposed to each other; a die holder mounted to the lower turret in such a manner as to freely adjust a position thereof so that the die is detachably mounted to the lower turret through the die holder; and fastening means for fastening the die holder to the lower turret.

In the structure mentioned above, in the turret punch press which rotates and divides the upper turret and the lower turret, positions a desired punch and die from a plurality of punches and a plurality of dies to a processing position, and performs a punching process in cooperation with the punch and the die, in the case that the core of the die with respect to the punch is offset at a time of replacing the die or after a long time use, since the fastening means fastening the die holder to the lower turret is freely adjusted its position, the position of the die can be adjusted by the fastening means with respect to the punch. Accordingly, the accuracy of the product can be made stable and the burr can be reduced, and further, the life of the metal mold can be extended. Further, when the die holder is greatly worn away, a process at a desired accuracy can be performed by replacing only the die holder.

Still further, since the upper surface of the die holder disposed at a position opposite to the processing position in the lower turret becomes a space, an erroneous insertion of the die can be easily recognized, and an inner portion of the die holder can be easily cleaned, so that a jamming between the punch and the die can be previously prevented.

According to a second aspect of the present invention, as it depends from the first aspect, the fastening means further comprises: a bolt for mounting the die holder to the lower turret; and a bolt hole provided in the lower turret, the bolt hole having an inner diameter sufficiently greater than an outer diameter of the bolt so that the bolt can pass through the bolt hole when the bolt is not fastened.

In the structure mentioned above, since the inner diameter of the bolt hole corresponding to the fastening means is sufficiently greater than the outer diameter of the bolt, the die holder can be moved with respect to the lower turret in a state of loosening the bolt so as to adjust the position. Accordingly, the clearance can be made even all around the periphery of the punching portion of the work, so that the burr generated in the work due to the punching can be previously prevented. Further, it is not necessary to accurately perform a punching process of the turret, and a productivity can be improved.

According to a third aspect of the present invention, as it depends from the first or the second aspect, the die holder further comprises: an upper die holder directly holding the die; and a lower die holder detachably to mount the upper die holder to the lower turret.

In the structure mentioned above, as well as only the die can be directly taken out at a time of replacing the die, in the adjustable separation type die holder, the upper die holder can be taken out from the lower die holder so as to be replaced. Further, since the lower die holder is mounted to the lower turret in such a manner that a position thereof can be freely adjusted, the position of the die can be adjusted by adjusting the position of the lower die holder.

According to a fourth aspect of the present invention, as it depends from the first or the second aspect, the die holder is an adjustable integration type die holder which is mounted to the lower turret in a state that the die holder keeps to hold the die.

In the structure mentioned above, at a time of replacing the die, only the die is directly taken out from the adjustable integration type die holder so as to be replaced. Further, since the die holder is mounted to the lower turret in such a manner that a position thereof can be freely adjusted, the position of the die can be adjusted by adjusting the position of the die holder.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
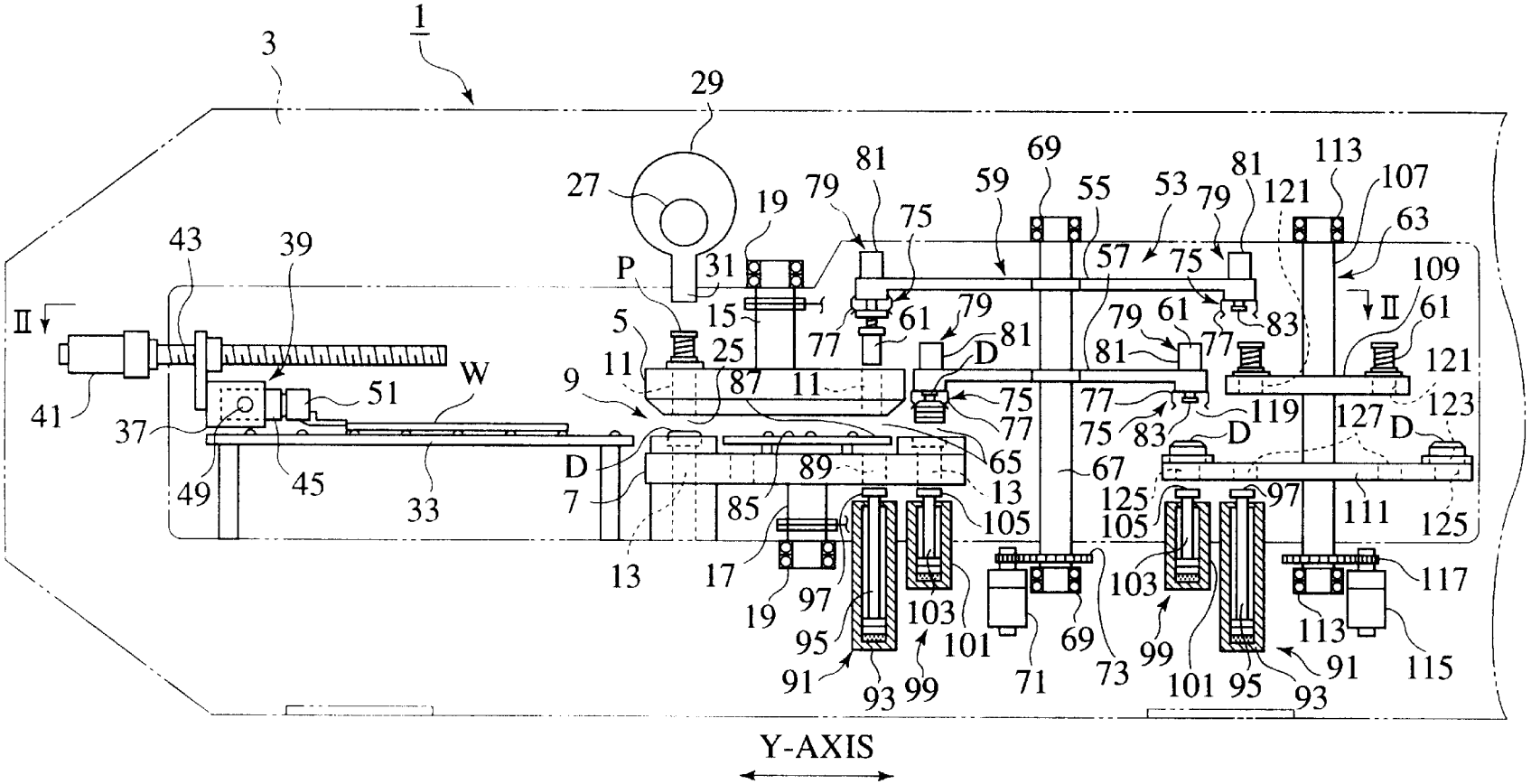
FIG. 1 is a front elevational view which shows a main portion of a turret punch press in accordance with the present invention.

There will be detailed below the preferred embodiments of the present invention with reference to the accompanying drawings. Like members are designated by like reference characters.

Figure 2:
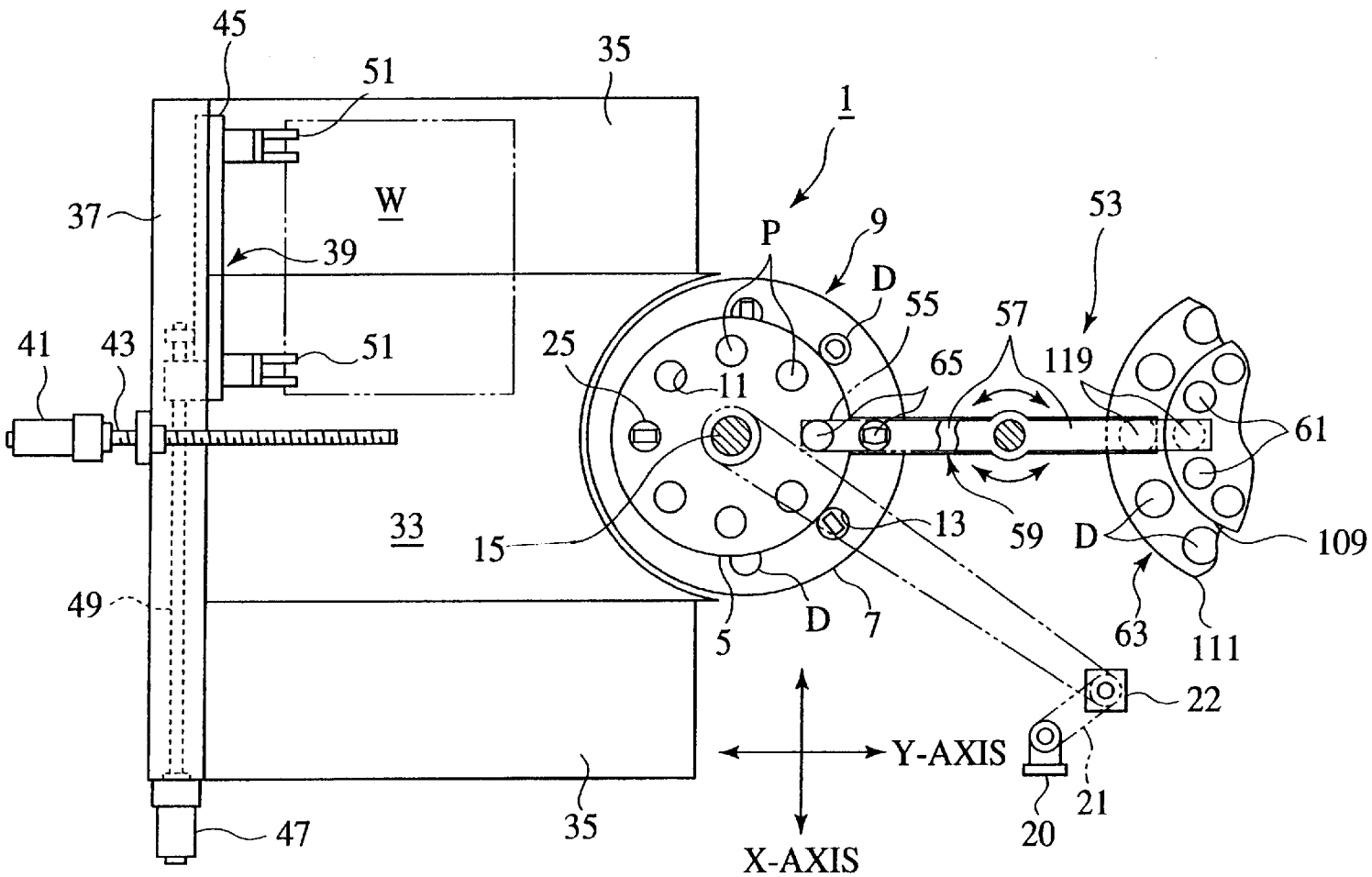
FIG. 2 is a cross sectional view along a line II—II in FIG. 1.

A turret punch press 1 in accordance with the present invention is shown in FIGS. 1 and 2. The turret punch press 1 is provided with a gate-like frame 3, and there is provided a turret 9 constituted by an upper turret 5 having a small diameter and disposed in a central upper portion within the gate-like frame 3 in a freely rotatable manner and a lower turret 7 having a great diameter and disposed in a central lower portion in a freely rotatable manner.

A plurality of holes 11 are provided on an outer peripheral portion of the upper turret 5, and a punch P is attached to the hole 11. A plurality of holes 13 are provided on an outer peripheral portion of the lower turret 7, and a die D is attached to the hole 13. A rotating axis 15 integrally provided with the upper turret 5 and a rotating axis 17 integrally provided with the lower turret 7 are supported by the gate-like frame 3 through a bearing 19.

Figure 3B:
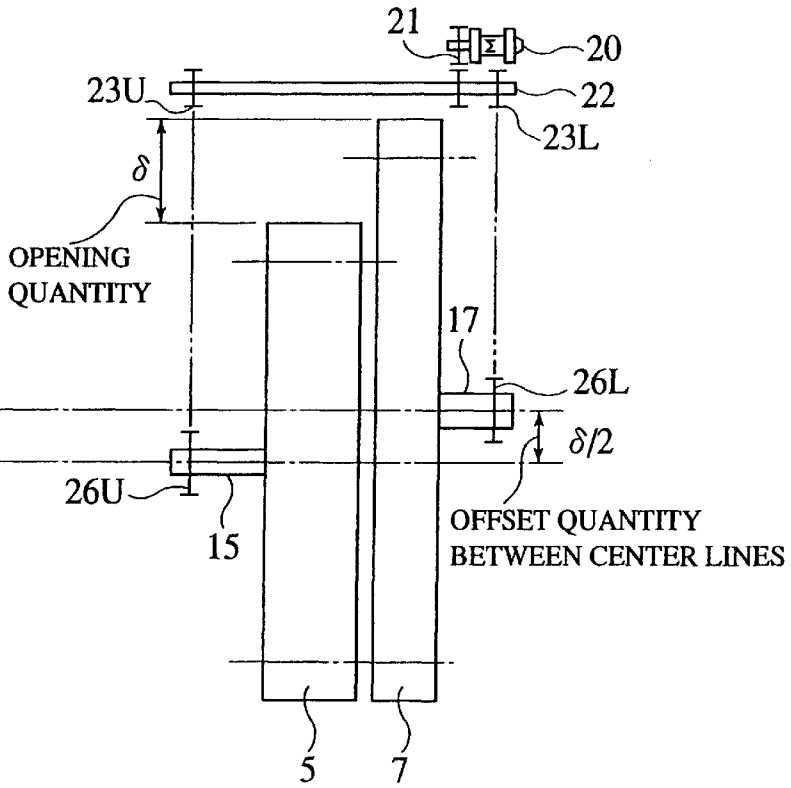
FIG. 3B is a front elevational view which shows a positional relation between the upper turret and the lower turret.
Figure 3A:
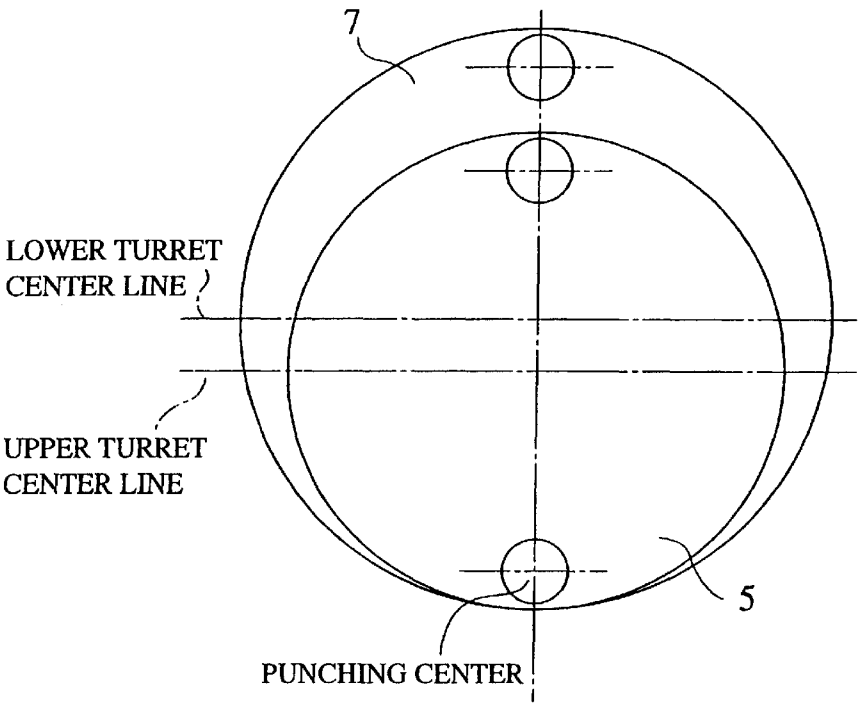
FIG. 3A is a plan view which shows a positional relation between an upper turret and a lower turret.

Further, with reference to FIGS. 2, 3A and 3B, in order to rotate the upper turret 5 and the lower turret 7, a rotating axis 22 is rotated by a drive motor 20, for example, through a chain belt and the like corresponding to a rotation transmitting member 21. A sprocket 23U for rotating the upper turret 5 and a sprocket 23L for rotating the lower turret 7 are fixed to the rotating axis 22. Both the sprockets 23U and 23L are structured such that a rotation is synchronously transmitted to the rotating axis 15 of the upper turret 5 through a sprocket 26U, for example, by means of a chain belt and the like corresponding to the rotation transmitting member 23U and to the rotating axis 17 of the lower turret 7 through a sprocket 26L, for example, by means of a chain belt and the like corresponding to the rotation transmitting member 23L, respectively.

A punching process position 25 is provided at the left of the turret 9. The punch P and the die D attached to the upper and lower turrets 5 and 7 are aligned at the punching process position 25, a crank shaft 27 is rotated to the punching process position 25 by means of a drive motor (not shown) disposed in the upper frame of the gate-like frame 3, the punch P and the die D are cooperated with each other through a connecting rod 29 and a striker 31, and a punching process is performed to a desired position of the work W positioned at the punching process position 25. In one embodiment, the striker 31 is vertically moved by cylinder (not shown) operated by a fluid pressure as a drive source.

A fixed center table 33 is provided at a lower portion in the gate-like frame 3, and a movable table 35 freely moving to a Y-axis direction (a lateral direction in FIGS. 1 and 2) is provided in both sides (in both sides of the upper and lower sides in FIG. 2) of the center table 33. The movable table 35 is guided by a plurality of guides (not shown) extending to a Y-axis direction and smoothly moved at a time of being moved to the Y-axis direction.

A carriage base 37 is extended to an X-axis direction (a direction perpendicular to a paper surface in FIG. 1, and a vertical direction in FIG. 2) on a left end of the movable table 35, and a work moving and positioning apparatus 39 is disposed in the carriage base 37. Accordingly, the carriage base 37 is structured such as to be freely moved through a nut member (not shown) by a screw rod 43 such as a ball screw, for example, by means of a servo motor 41 moving to the Y-axis direction.

Then, a carriage 45 freely moving to the X-axis direction is disposed in the carriage base 37, which is moved through a nut member (not shown) by a screw rod 49 such as a ball screw, for example, by means of a servo motor 47, and a plurality of work clamps 51 gripping the work W are mounted to the carriage 45.

In accordance with the structure mentioned above, as well as the carriage base 37 is moved to the Y-axis direction, the carriage 45 is moved to the X-axis direction, so that the work W gripped by the work clamp 51 is moved to the X-axis direction and the Y-axis direction, and the desired position to be processed is disposed at the punching process position 25, thereby performing the punching process.

A punch-die replacing apparatus 53 is disposed in adjacent to the right side of the upper and lower turrets 5 and 7.

The punch-die replacing apparatus 53 is constituted by a tool changing device 59 provided with a punch changing device arm 55 and a die changing device arm 57, and a tool magazine 63 housing a punch metal mold set 61 and the die D.

With reference to FIGS. 1 and 3B, the upper and lower turrets 5 and 7 have an opening quantity δ in the outer diameter and have an opening quantity in a side opposite to the punching process position 25, so that the place serves as, a replacing position 65 for the punch and the die. The tool changing device 59 is disposed adjacent to the replacing position 65.

Next, a structure of the tool changing device 59 and the tool magazine 63 will be described below. The tool changing device 59 is provided with a changing device arm 55 for the long punch and a changing device arm 57 for the short die in both sides thereof, and they are respectively structured to be integral and are disposed to project from a support column 67. The support column 67 is rotatably supported by the gate-like frame 3 through the bearing 69 positioned at in both ends. As a drive system, the support column 67 is structured to be freely rotated by a rotation transmitting member 73, for example, constituted by a gear and the like by means of an electric motor 71.

A gripping apparatus 75 for gripping the punch metal mold set 61 is suspended at a front end of each of the punch changing device arms 55, for example, the gripping apparatus 75 is a plate spring gripping device 77, and a lower end portion of the plate spring gripping device 77 grips a head portion of the punch P assembled in the punch metal mold set 61. Further, for example, a cylinder 81 operated by fluid pressure is provided as a pressing member 79, and a disc 83 is provided at a front end of a piston rod (not shown) of the cylinder 81.

The same apparatus 75 and the same pressing member 79 as that in the case of the punch changing device arm 55 mentioned above are provided in the die changing device arm 57. The plate spring gripping device 77 serving as the gripping apparatus 75 can be freely engaged and disengaged with the die D.

In this case, a hole to which the punch metal mold set 61 is inserted is provided in an outer peripheral portion of the upper turret 5, and a hole 87 having the same diameter is provided immediately below the hole 11 of the upper turret 5 in the turret table 85 supporting the work W. Further, a hole 89 having the same diameter is provided immediately below the hole 87 in the lower turret 7, and a punch pushing-up member 91 is provided immediately below the hole 89.

The punch pushing-up member 91 is, for example, a cylinder 93 operated by fluid pressure, and a pushing-up plate 97 is provided at a front end of the piston rod 95. Further, a die pushing-up member 99 having the same structure as that of the punch pushing-up member 91 is provided at a position corresponding to the immediately below position of the die D positioned at the replacing position 65, and has a cylinder 101, a piston rod 103, a pushing-up plate 105 and the like.

In accordance with the structure mentioned above, in order to take out the used punch P and die D attached to the upper and lower turrets 5 and 7, the punch changing device arm 55 and the die changing device arm 57 are positioned to the replacing position 65 for the punch P and the die D. Then, the punch P and the die D are pushed up by means of the punch pushing-up member 91 and the die pushing-up member 99.

The punch metal mold set 61 and the die D pushed up are gripped by the gripping apparatus 75 provided in the punch changing device arm 55 or the die changing device arm 57. After gripping, the punch pushing-up member 91 and the die pushing-up member 99 are descended, the support column 67 integrally having each of the changing device arms 55 and 57 is rotated 180 degrees so as to be positioned at a housing position of the tool magazine 63, thereby housing the punch P and the die D.

Further, after the desired punch P and the die D are taken out from the tool magazine 63 and each of the changing device arms 55 and 57 is positioned at the replacing position 65, the cylinder 81 corresponding to the pressing member 79 is operated so as to fit the punch P to the hole 11 in the upper turret 5 and fit the die D to the hole 13 in the lower turret 7.

The tool magazine 63 is provided with a disc 109 for the punch having a small diameter in the upper step of the support column 107 and with a disc 111 for the die having a large diameter in the lower step. The punch metal mold set 61 and the die D are respectively housed in the punch disc 109 and the die disc 111, and the punch disc 109 and the die disc 111 are set at a replacing position 119 corresponding to the replacing position 65 in the upper turret 5 and the lower turret 7 mentioned above.

The support column 107 is rotatably supported to the gate-like frame 3 through the bearing 113 at both ends thereof. In the drive system, the support column 107 can be freely rotated by the rotation transmitting member 117, for example, constituted by a gear and the like by means of the electric motor 115. In this case, the electric motor 115 and the electric motor 71 for the tool changing device 59 mentioned above are performed by a rotation control in order to set the punch changing device arm 55, the die changing device arm 57, the punch disc 109 and the die disc 111 to the replacing positions 65 and 119.

The cylinders 93 and 101 which are absolutely the same as the punch pushing-up member 91 and the die pushing-up member 99 provided immediately below the replacing position 65 for the upper turret 5 and the lower turret 7 mentioned above, are provided immediately below the replacing position 119 for the punch disc 109 and the die disc 111. A plurality of holes 121 to which the punch metal mold set 61 having the punch P is inserted are provided in the punch disc 109, and a plurality of holes 123 and 125, the hole 123 to which the die D is inserted and the hole 125 through which the pushing-up plate 105 provided in the piston rod 103 of the cylinder 101 corresponding to the die pushing-up member 99 passes, are provided in the die disc 111. Further, in the die disc 111, a hole 127 through which the pushing-up plate 97 provided in the piston rod 95 of the cylinder 93 corresponding to the punch pushing-up member 91 passes, is punched immediately below the hole 121 to which the punch metal mold set 61 is inserted.

In accordance with the structure mentioned above, the electric motor 115 is driven, the punch disc 109 and the die disc 111 provided in the support column 107 through the rotation transmitting member 117 are rotated, and the desired punch P and the die D are positioned at the replacing position 119. Then, the cylinder 93 corresponding to the punch pushing-up member 91 and the cylinder 101 corresponding to the die pushing-up member 99 are operated so as to push up the respective piston rods 95 and 103 and to push up the punch metal mold set 61 and the die D by the pushing-up plates 97 and 105, so that the replacement is performed by gripping the punch metal mold set 61 and the die D by means of the plate spring gripping device 77 corresponding to the gripping apparatus 75 provided in the punch and die changing device arms 55 and 57. In this case, the motion of housing the punch metal mold set 61 and the die D to the punch disc 109 and the die disc 111 is the same as the motion of the tool changing device 59 mentioned above.

In accordance with the structure mentioned above, as an operation of the punch-die replacing apparatus 53, at first, the upper and lower turrets 5 and 7 are rotated, and the used punch P and the die D are positioned to the replacing position 65. Moreover, the desired punch P and the die D to be replaced which are housed in the punch disc 109 and the die disc 111 in the tool magazine 63 are positioned to the replacing position 119. Then, the punch changing device arm 55 and the die changing device arm 57 in the tool changing device 59 are positioned to the replacing positions 65 and 119.

A replacing operation starts in this state. Accordingly, in the end of the upper and lower turrets 5 and 7, the cylinders 93 and 101 corresponding to the punch pushing-up member 91 and the die pushing-up member 99 are operated so as to push up the punch P and the die D, thereby gripping the punch metal mold set 61 and the die D by means of the plate spring gripping device 77 corresponding to the gripping apparatus 75 for the punch changing device arm 55 and the die changing device arm 57. When the punch metal mold set 61 and the die D are gripped, the punch pushing-up member 91 and the die pushing-up member 99 are descended so as to be returned to the original position.

Moreover, in the end of the tool magazine 63, since the desired punch P and die D to be replaced are positioned, the cylinders 93 and 101 corresponding to the punch pushing-up member 91 and the die pushing-up member 99 are operated so as to push up the punch P and the die D to be replaced, thereby gripping the punch metal mold set 61 and the die D by means of the plate spring gripping device 77 corresponding to the gripping apparatus 75 for the punch changing device arm 55 and the die changing device arm 57. When the punch metal mold set 61 and the die D are gripped, the punch pushing-up member 91 and the die pushing-up member 99 are descended so as to be returned to the original position.

Next, by rotating the punch changer arm 55 and the die changing device arm 57 at 180 degrees, as well as the punch P and the die D in the desired next stage are positioned to the replacing position 65 of the upper and lower turrets 5 and 7, the used punch P and die D are positioned at the replacing position 119 corresponding to an empty housing portion at the tool magazine 63.

In this state, in the end of the upper and lower turrets 5 and 7, the cylinder 81 corresponding to the pressing member 79 provided in the punch changing device arm 55 and the die changing device arm 57 is operated so as to press a head portion of the punch P or an upper surface of the die D, and a locking of the plate spring gripping device 77 corresponding to the gripping apparatus 75 is removed so as to drop and insert the punch metal mold set 61 into the hole 11 of the upper turret 5. Further, the die D is dropped and inserted into the hole 13 of the lower turret 7, thereby finishing an attaching operation between the punch metal mold set 61 and the die D.

Moreover, also in the end of the tool magazine 63, by performing the same operation as the operation mentioned above, the used punch metal mold set 61 is housed in the hole 121 of the punch disc 109 and the used die D is housed in the hole 123 of the die disc 111, thereby finishing a housing operation between the punch metal mold set 61 and the die D.

In accordance with the result mentioned above, as shown in FIGS. 3A and 3B, since the outer diameter of the lower turret 7 is greater than the outer diameter of the upper turret 5, the replacing operation of the die D can be performed from the immediately above portion, thereby making the operation easy, and since a space is not limited on designing the die D, the die can be designed in a more effective manner. Particularly, a space for housing a part for the forming die can be made large. Further, an automatic replacement of an auto index station die which has been very hard in view of a spatial problem in the past time can be performed. Accordingly, a structure of the automatic replacing apparatus for the die in the station including the auto index is made more simple. In this case, in identifying the die D, it is preferable to utilize, for example, an ID chip for non-contact type data communication.

Figure 4:
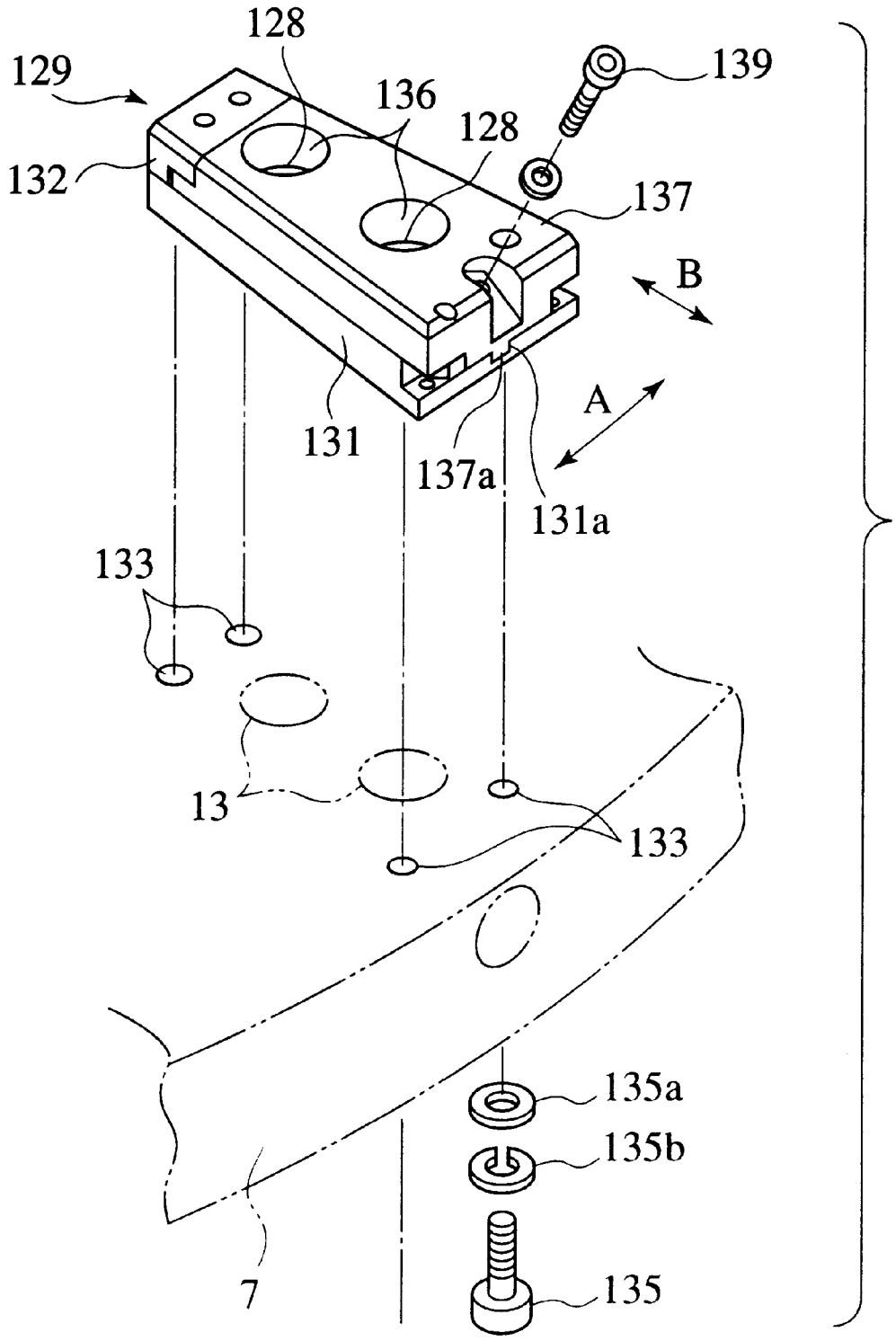
FIG. 4 is an exploded perspective view which shows a structure of mounting a die.
Figure 5:
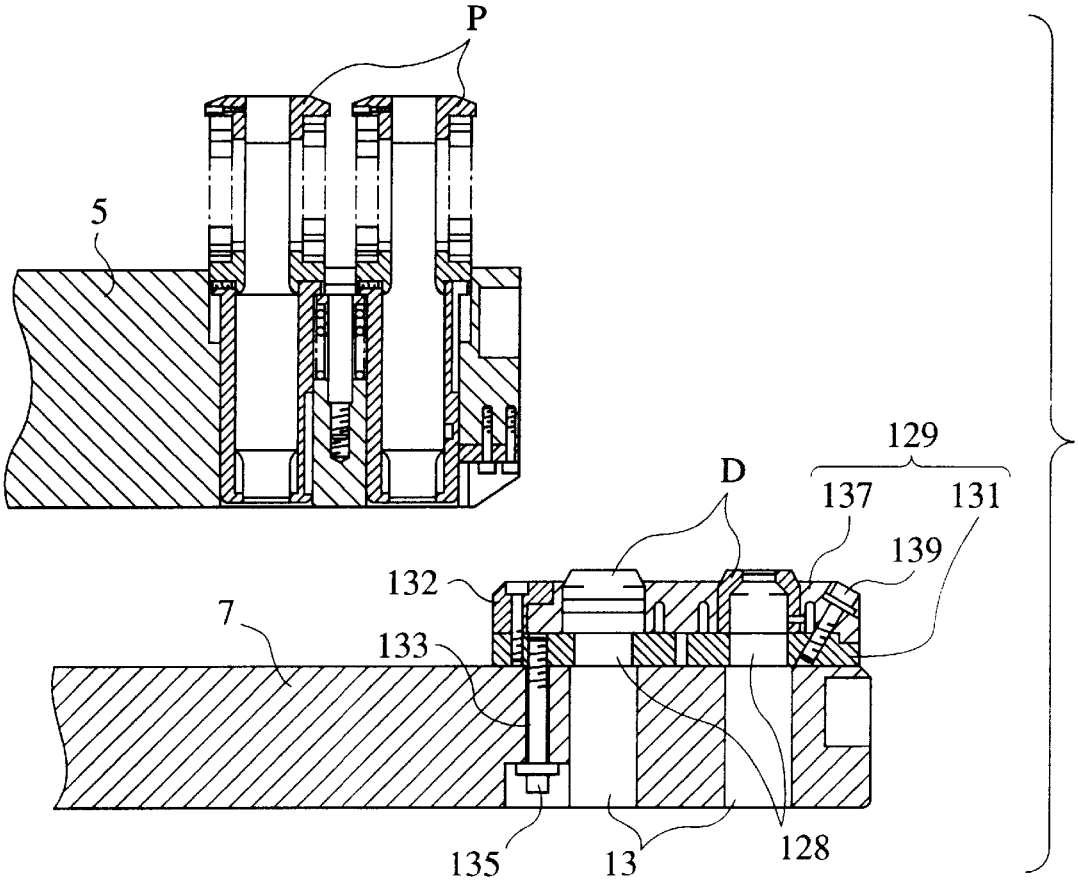
FIG. 5 is a side elevational view which shows a positional relation between a punch and a die at a replacing position.

A detail of the mounting portion of the die D in the lower turret 7 is shown in FIGS. 4 and 5. A lower die holder 131 of an adjustable separation type die holder 129 having a hole 128 corresponding to the hole 13 of the lower turret 7 is mounted to the upper surface of the lower turret 7. The lower die holder 131 is mounted to the lower turret 7 through four bolt holes 133 disposed in the lower turret 7 by means of four set of die mounting bolts 135, spring washers 135*b* and washers 135*a*.

In this case, a diameter of the bolt hole 133 is made greater than an outer diameter of the die mounting bolt 135. More particularly, the bolt hole 133 having a diameter 1.2 to 1.6 times the outer diameter of the die mounting bolt 135 is previously formed. Further, with respect to the washer 135*a*, the washer manufactured in such a manner as to make an inner diameter thereof the same dimension as that of the normal washer and make an outer diameter of the washer 135*a* 1.2 to 1.6 times the outer diameter of the normal washer is used.

Moreover, a key groove 131*a* is formed on the upper surface of the lower die holder 131. A key 137*a* fitting to the key groove 131*a* is formed on the lower surface of the upper die holder 137. A hole 136 mounting the die D is formed in the upper die holder 137. A locking member 132 is meshed with the lower die holder 131 in the center end of the lower turret 7.

In the case of mounting the upper die holder 137 to the lower die holder 131, the lower die holder 131 is moved to the center end of the lower turret 7 with fitting the key 137*a* to the key groove 131*a* so as to slide. Then, the upper die holder 137 stops sliding at a position in which the front end of the lower die holder 131 is brought into contact with the locking member 132. Further, by fastening a corner bolt 139, the upper die holder 137 is mounted to the lower die holder 131 with bringing the front end of the upper die holder 137 into contact with the locking member 132.

In accordance with the structure mentioned above, the die D is mounted to the lower turret 7 through the lower die holder 131 and the upper die holder 137, however, since the bolt hole 133 provided in the lower die holder 131 is sufficiently greater than the diameter of the die mounting bolt 135, the position of the lower die holder 131 can be adjusted to A and B directions in FIG. 4 on the upper surface of the lower turret 7.

As a result, the die D can be replaced without disassembling the adjustable separation type die holder 129 even at a time of replacing the die D. Further, when the core of the die D is offset with respect to the punch P after replacement of the die D or due to the abrasion in accordance with the long time use, the alignment can be easily performed by loosening the die mounting bolt 135 and adjusting the position of the adjustable separation type die holder 129. Accordingly, the accuracy of the product can be made stable and burry can be reduced, and further the life of the metal mold can be extended. Further, when the die holders 131 and 137 are severely worn, a process at a desired accuracy can be performed by replacing only the die holders 131 and 137.

Next, a second embodiment modifying the die holder mentioned above will be described below with reference to FIGS. 6 and 7.

Figure 6:
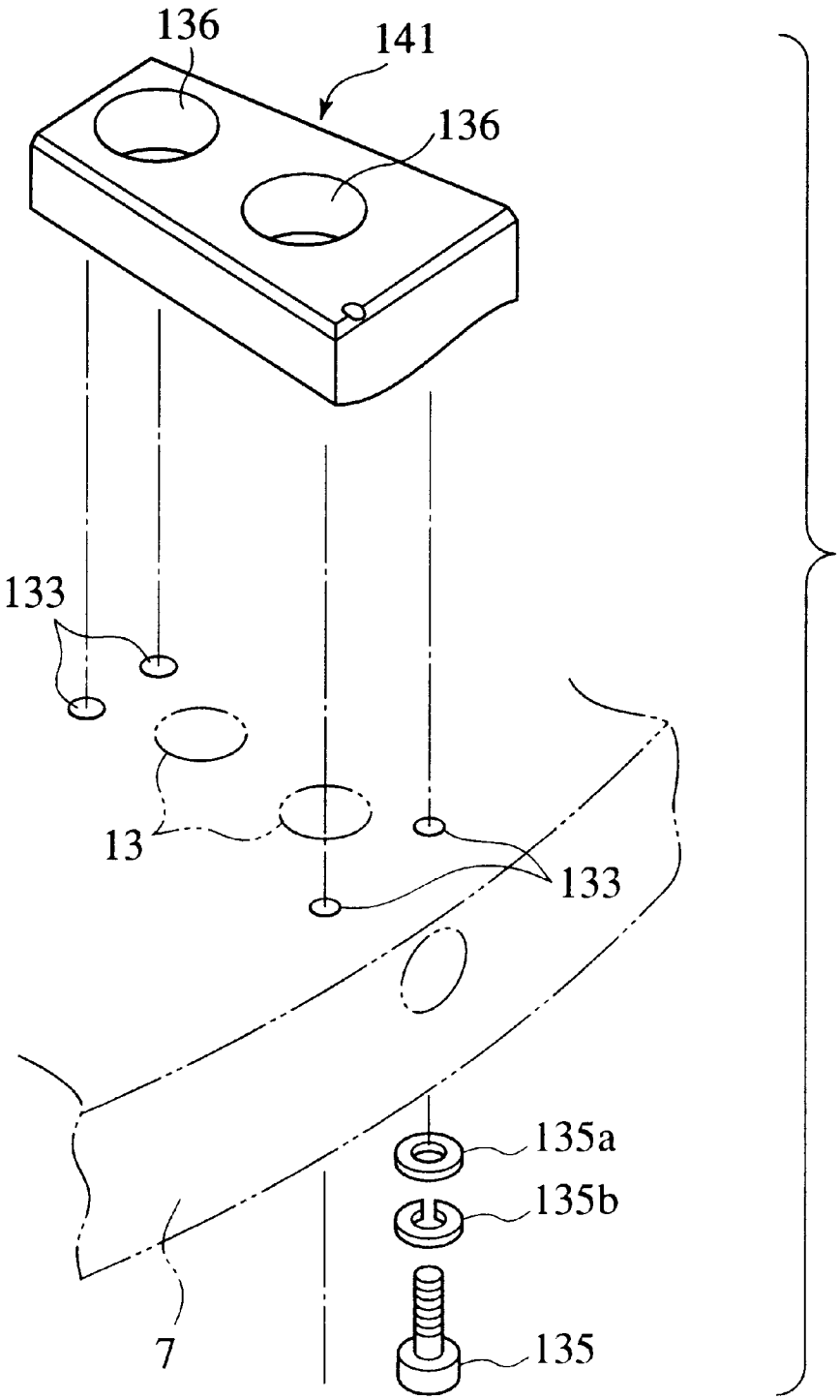
FIG. 6 is an exploded perspective view which shows a structure of mounting a die in accordance with a second embodiment.
Figure 7:
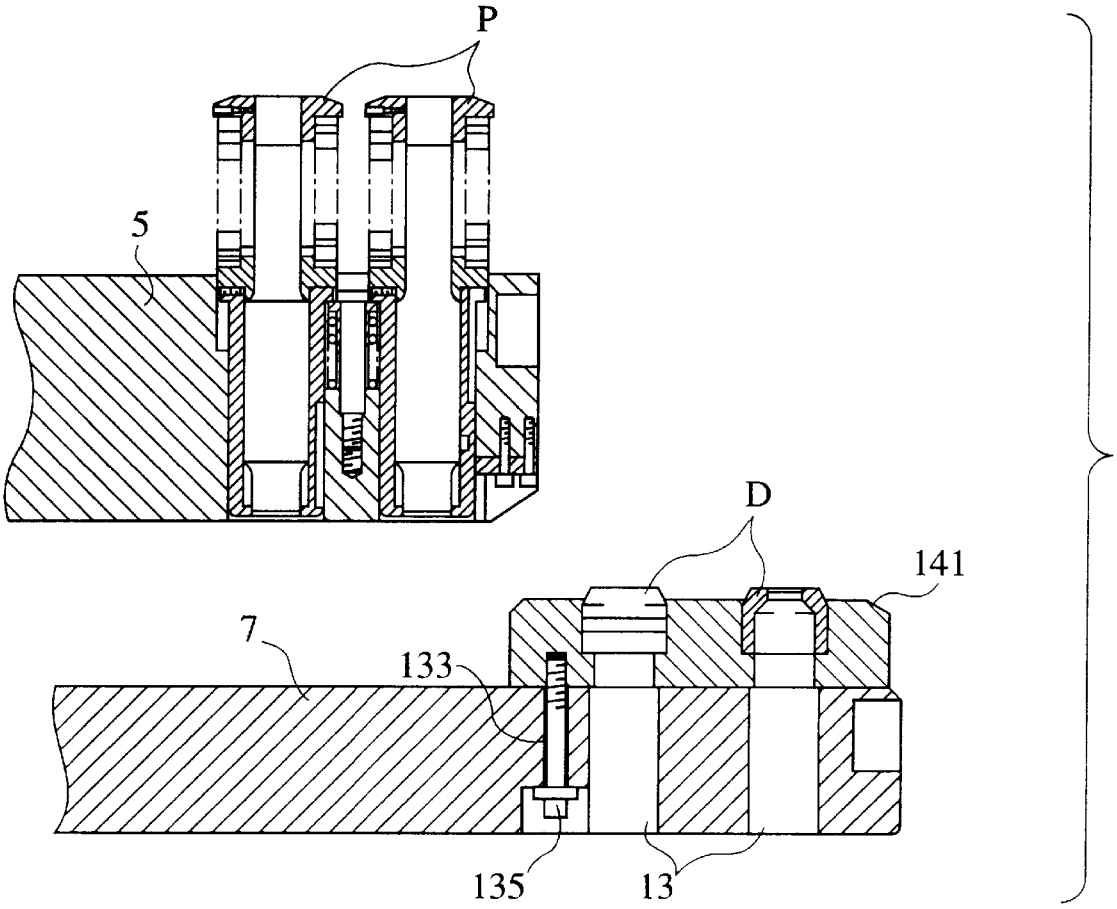
FIG. 7 is a side elevational view which shows a positional relation between the punch and the die at a replacing position in accordance with the second embodiment.

In the embodiment mentioned above, the explanation is given to the case of using the adjustable separation type die holder 129, however, as shown in FIGS. 6 and 7, the same structure will be given to the case of using an adjustable integral type die holder 141. In this case, the die D can be replaced without removing the adjustable integral type die holder 141 at a time of replacing the die D, and the position of the adjustable integral type die holder 141 is adjusted by loosening the die mounting bolt 135, so that the die D can be easily aligned with respect to the punch P.

Further, in the embodiment mentioned above, as shown in FIGS. 4 to 7, the explanation is given to the case of mounting two series of dies D, however, the same structure will apply to the mounting a single die D.

While preferred embodiments of the present invention have been described using specific terms, such description is for illustrative purposes, and it is to be understood that changes and variations may be made without departing from the spirit or scope of the following claims.

What is claimed is:

1. A turret punch press, comprising:

an upper turret holding a plurality of punches, the upper turret being freely rotatable and indexed;

a lower turret having a diameter greater than a diameter of the upper turret, and including a plurality of bolt holes, the lower turret holding a plurality of dies for performing a punching process in cooperation with the plurality of punches, the lower turret being freely rotatable and indexed, and the lower turret being rotatably supported at a processing position in such a manner that a selected punch and a selected die are opposed to each other;

a plurality of die holders, each die holder being freely adjustably mounted to the lower turret, the mounting being freely adjustable in any direction of a plane containing a face of the turret, wherein each of the plurality of dies is detachably mounted to the lower turret through one of the die holders; and at least one bolt for mounting each die holder to the lower turret, the at least one bolt passing through a respective bolt hole, each bolt hole having an inner diameter sufficiently greater than an outer diameter of the bolt to permit the freely adjustable mounting, said at least one bolt thereby fastening each of the die holders to the lower turret.

2. The turret punch press according to claim 1, wherein the die holder further comprises: an upper die holder directly holding the die; and a lower die holder that detachably mounts the upper die holder to the lower turret.

3. The turret punch press according to claim 1, wherein the die holder is an adjustable integral die holder which is mounted to the lower turret to hold the die.

4. The turret punch press of claim 1, further comprising a washer having an inner diameter equal to an inner diameter of a normal washer and having an outer diameter that is 1.2 to 1.6 times larger than a diameter of the a normal washer.

5. A turret punch press, comprising:

an upper turret holding a plurality of punches, the upper turret being freely rotatable and indexed;

a lower turret having a diameter greater than a diameter of the upper turret, and including a plurality of bolt holes, the lower turret holding a plurality of dies for performing a punching process in cooperation with the plurality of punches, the lower turret being freely rotatable and indexed, and the lower turret being rotatably supported at a processing position in such a manner that a selected punch and a selected die are opposed to each other;

a plurality of die holders, each die holder being freely adjustably mounted to the lower turret, the mounting being freely adjustable in any direction of a plane containing a face of the turret, wherein each of the plurality of dies is detachably mounted to the lower turret through one of the die holders; and at least one bolt for mounting each die holder to the lower turret, the at least one bolt passing through a respective bolt hole, each bolt hole having an inner diameter 1.2 to 1.6 times greater than an outer diameter of the bolt to permit the freely adjustable mounting, said at least one bolt thereby fastening each of the die holders to the lower turret.

6. The turret punch press according to claim 5, wherein the die holder further comprises: an upper die holder directly holding the die; and a lower die holder that detachably mounts the upper die holder to the lower turret.

7. The turret punch press according to claim 5, wherein the die holder is an adjustable integral die holder which is mounted to the lower turret to hold the die.

8. The turret punch press of claim 7, further comprising a washer having an inner diameter equal to an inner diameter of a normal washer and having an outer diameter that is 1.2 to 1.6 times larger.

* * * * *

UNITED STATES PATENT AND TRADEMARK OFFICE

CERTIFICATE OF CORRECTION

PATENT NO. : 6,109,159
DATED : August 29, 2000
INVENTOR(S) : Y. Seto

It is certified that error appears in the above-identified patent and that said Letters Patent is hereby corrected as shown below:

Column 10,
Line 12, after "the" delete "a".
Line 49, "7" should be -- 5 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*